US009316226B2

(12) United States Patent
Ishibashi et al.

(10) Patent No.: US 9,316,226 B2
(45) Date of Patent: Apr. 19, 2016

(54) GAS COMPRESSOR FOR REDUCING OSCILLATION IN A HOUSING THEREOF

(71) Applicant: CALSONIC KANSEI CORPORATION, Saitama (JP)

(72) Inventors: Yasufumi Ishibashi, Saitama (JP); Masayoshi Tajiri, Saitama (JP); Keita Satou, Saitama (JP)

(73) Assignee: CALSONIC KANSEI CORPORATION, Saitama (JP)

( * ) Notice: Subject to any disclaimer, the term of this patent is extended or adjusted under 35 U.S.C. 154(b) by 43 days.

(21) Appl. No.: 14/341,945

(22) Filed: Jul. 28, 2014

(65) Prior Publication Data

US 2015/0064044 A1 Mar. 5, 2015

(30) Foreign Application Priority Data

Aug. 27, 2013 (JP) ..... 2013-175442

(51) Int. Cl.

| | |
|---|---|
| ***F03C 2/00*** | (2006.01) |
| ***F04C 2/00*** | (2006.01) |
| ***F04C 18/00*** | (2006.01) |
| ***F04C 18/344*** | (2006.01) |
| ***F04C 2/344*** | (2006.01) |
| ***F01C 21/08*** | (2006.01) |
| ***F01C 21/10*** | (2006.01) |

(52) U.S. Cl.

CPC ..... *F04C 18/3446* (2013.01); *F01C 21/0809* (2013.01); *F01C 21/10* (2013.01); *F04C 2/3442* (2013.01); *F04C 2270/12* (2013.01)

(58) Field of Classification Search

CPC ..... F04C 2/324; F04C 2/3442; F04C 18/344; F04C 18/3446; F04C 2270/12; F01C 21/0809; F01C 21/10

USPC ..... 418/236–238, 259, 266–268

See application file for complete search history.

(56) References Cited

U.S. PATENT DOCUMENTS

| | | | | |
|---|---|---|---|---|
| 4,505,656 | A * | 3/1985 | Adalbert | F04C 29/128 418/268 |
| 2009/0246055 | A1* | 10/2009 | Stehouwer | F04C 18/0215 418/55.1 |
| 2012/0301343 | A1* | 11/2012 | Satou | F01C 21/0872 418/84 |
| 2015/0023813 | A1* | 1/2015 | Ishibashi | F04C 18/344 417/316 |

FOREIGN PATENT DOCUMENTS

| | | |
|---|---|---|
| JP | 2008-95566 | 4/2008 |

* cited by examiner

*Primary Examiner* — Theresa Trieu

(74) *Attorney, Agent, or Firm* — Wenderoth, Lind & Ponack, L.L.P.

(57) ABSTRACT

A gas compressor can efficiently reduce an oscillation (damping) generated in a housing even if the oscillation generated in a cylinder is directly propagated to the housing during operating. Each of a plurality of ribs extends from a respective one of the fitting units to the vicinity of a position where an outer surface of a rear side block of a compressing mechanism unit received in the housing is fitted (pressingly fitted) to an inner surface of the housing. The ribs are integral formed on the outer surface of the housing.

3 Claims, 2 Drawing Sheets

GAS COMPRESSOR FOR REDUCING OSCILLATION IN A HOUSING THEREOF

CROSS-REFERENCE TO RELATED APPLICATION

This application claims priority from Japanese Patent Application No. 2013-175442 filed on Aug. 27, 2013, the disclosure of which is herein incorporated by reference.

BACKGROUND OF THE INVENTION

1. Field of the Invention

The present invention relates to a gas compressor disposed in an air conditioner mounted in a vehicle and the like.

2. Description of the Related Art

For example, an air conditioner for adjusting temperature in a compartment is disposed in a vehicle. Such an air conditioner has a loop refrigerant cycle in order to circulate a refrigerant (cooling medium). This refrigerant cycle includes an evaporator, a gas compressor, a condenser, and an expansion valve in that order. The gas compressor of the air conditioner compresses a gaseous refrigerant (refrigerant gas) in order to generate a high pressure refrigerant gas, and discharge the gas to the condenser.

Conventionally, the vane rotary air compressor is known as such a gas compressor (ex., see Patent Document 1 (Japanese Patent Application Publication No. 2008-095566)). This vane rotary air compressor includes a rotatable rotor having a plurality of vanes which are telescopically disposed in a cylinder having a substantially oval inner surface. Top ends of the vanes are in sliding contact with the inner surface of the cylinder.

The vane rotary gas compressor described in the Patent Document 1 includes a rotor incorporated in a rotating axis; a cylinder having an inner surface which surrounds the rotor on the outer surface of the rotor; a plurality of vanes extending from the outer surface of the rotor to the inner surface of the cylinder; and a compressing mechanism unit having two side blocks which cover both ends of the rotor and the cylinder and rotatably supports both sides of the rotating axis.

This compressing mechanism unit decreases a volume of the compressing room formed between the outer surface of the rotor and the inner surface of the cylinder by two adjacent vanes, resulting in compressing the low pressure refrigerant gas introduced to the compressing room and exhausting the compressed high pressure refrigerant gas to an exterior.

This compressing mechanism unit is received in a housing having an opening at a first end. The opening at the first end is covered by the front head (hereinafter, left and right sides of FIGS. 1 to 3 are defined as first and second sides or first and second ends, respectively.). In detail, the outer surface of the side block at the second end of the compressing mechanism unit (opposed to the front head) is fitted (pressingly fitted) into the inner surface of the housing. The outer side of the side block at the first end of the compressing mechanism unit (front head side) is fixed in the front head via the bolt.

Because an exciting force such as a compress reaction force, which is generated by rotating the rotating axis (rotor), is periodically propagated in a cylinder when compressing a refrigerant gas in a compressing room, a periodic oscillation is generated in the cylinder while operating the above vane rotary air compressor.

The oscillation generated in the cylinder is directly propagated to the housing via a second end of a side block and the housing is also oscillated since the second end of the side block of the compressing mechanism unit is fitted (pressingly fitted) into the inner surface of the housing.

Now, the case that a vehicle engine, which drives the rotating axis (a rotor) as a driving source, and is disposed in the vicinity of the gas compressor, is considered. Since the fitting unit formed at the outer surface of the housing is fixed to an engine bracket which attaches this engine via the bolt and the like, it has a disadvantage that the oscillation of the housing is propagated to the engine bracket via this fitting unit.

SUMMARY OF THE INVENTION

The present invention has been made to resolve the above problem, and it is an object of the present invention to provide a gas compressor which can efficiently reduce the oscillation generated in the housing even if the oscillation generated in the cylinder is directly propagated to the housing while operating the gas compressor.

To accomplish the above object, a gas compressor according to an embodiment of the present invention includes: a substantially cylindrical housing which has an opening at a first end and having a bottom portion at a second end; a front head which covers an end face of the opening of the housing; a compressing mechanism unit which is fixed in the front head at a first end, is received in the housing excluding a portion of the first end, and exhausts a compressed high pressure medium to an exterior by rotating a rotating axis due to a driving force from a driving source; a fitting unit which is formed on an outer surface at the end face of the opening of the housing and is fixed to an external structure member; and at least one rib. An outer surface of a second end of the compressing mechanism unit is fixed to be pressingly fitted to an inner surface of the housing, and the at least one rib which extends from the fitting unit to a position where the second end of the compressing mechanism unit on the outer surface of the housing is pressingly fitted to the inner surface of the housing, is integral formed with the outer surface of the housing.

DETAILED DESCRIPTION OF THE PREFERRED EMBODIMENTS

Figure 1:
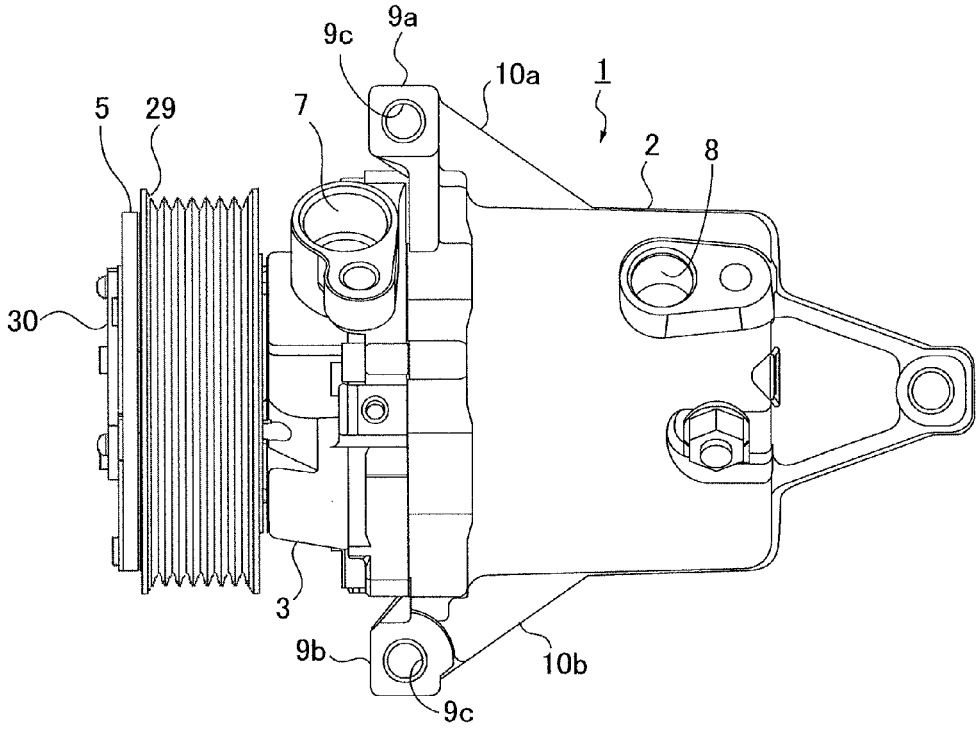
FIG. 1 is a perspective view showing a gas compressor (a vane rotary gas compressor) in accordance with an embodiment of the present invention.
Figure 2:
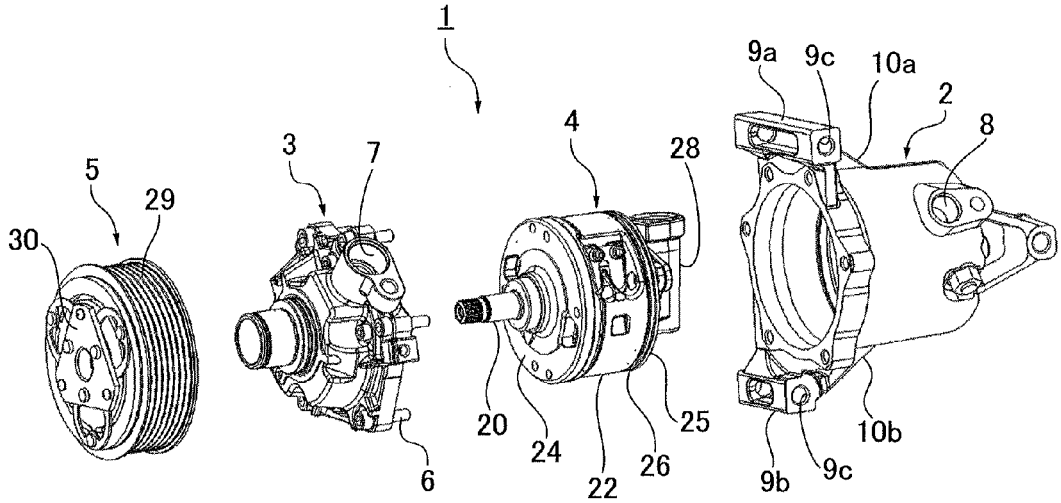
FIG. 2 is an exploded perspective view of the gas compressor.

An embodiment of the present invention will be described hereinafter in detail with reference to the accompanying drawings. FIG. 1 is an external view showing a vane rotary type gas compressor (hereinafter, referred to as a compressor) as a gas compressor in accordance with the embodiment of the present invention. FIG. 2 is an exploded perspective view of the gas compressor.

(Entire Structure of the Compressor 1)

A compressor 1, for example, constitutes a part of the air conditioning system, which executes cooling, using vaporization heat. The compressor 1 is disposed on a circulating path of cooling medium as well as a condenser (not shown), an expansion valve (not shown), and an evaporator (not shown) which are other elements of this air conditioning system. Such an air conditioning system includes an air conditioner for adjusting temperature in a compartment of the vehicle (ex., an automobile).

The compressor 1 compresses a refrigerant gas as the gaseous cooling medium from the evaporator of the air conditioning system, and supplies this compressed refrigerant gas to the condenser of the air conditioning system. The condenser liquefies the compressed refrigerant gas. The liquefied refrigerant is supplied to the expansion valve under high pressure. This high pressure liquefied refrigerant is decompressed by the expansion valve, and is sent to the evaporator. The liquefied refrigerant under a low pressure is vaporized by heat being absorbed from surrounding air in the evaporator. The air surrounding in the evaporator is cooled by heat exchanging to this evaporation heat.

As shown in FIGS. 1 and 2, the compressor 1 includes a substantially cylindrical metal housing 2 which has at a first end thereof an opening (left hand side in FIGS. 1 and 2) and is closed at a second end; the metal front head 3 which covers the opening at the first end of the housing 2; a compressing mechanism unit 4 which is received in the housing 2; and an electromagnetic clutch 5 transmitting the driving force from the engine of the vehicle (the automobile) (not shown) as the driving source to the compressing mechanism unit 4.

A front head 3 is formed in a cover shape for covering the end face of the opening of the housing 2, and is fixed to the opening at the first end of the housing 2 via a plurality of bolts 6. The front head 3 includes an intake port 7 which supplies the low pressure refrigerant gas from the evaporator (not shown) of the air conditioning system. The housing 2 includes an exhaust port 8 which exhausts the high pressure compressed refrigerant gas in the compressing mechanism unit 4 to the condenser of the air conditioning system (not shown).

Figure 3:
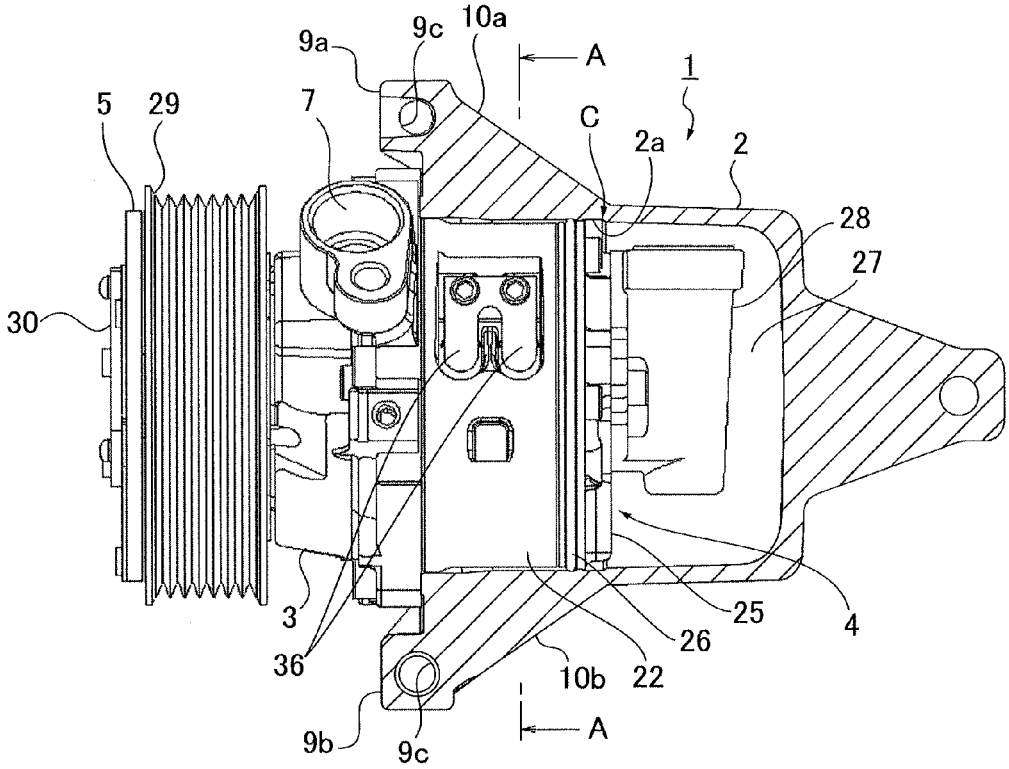
FIG. 3 is a cross-sectional view of the gas compressor viewed from a housing side.

Fitting units (i.e., brackets) 9*a* and 9*b* are formed at the opposed position in a radial direction of the outer surface in the vicinity of the opening of the housing 2 in order to be fixed to the engine bracket (not shown) which attaches the vehicle engine via the bolts. As shown in FIGS. 1 and 3, ribs 10*a* and 10*b* are integrally formed between the fitting units 9*a* and 9*b* and the outer surface of the housing 2. In the case of an even number of the ribs, one of the ribs is arranged to face the other of them, as illustrated in FIGS. 1 and 3. The detail of the ribs 10*a* and 10*b* which are an essential feature of the present invention is described as follows. FIG. 3 is a cross-sectional view of the compressor 1 viewed from the housing 2.

Figure 4:
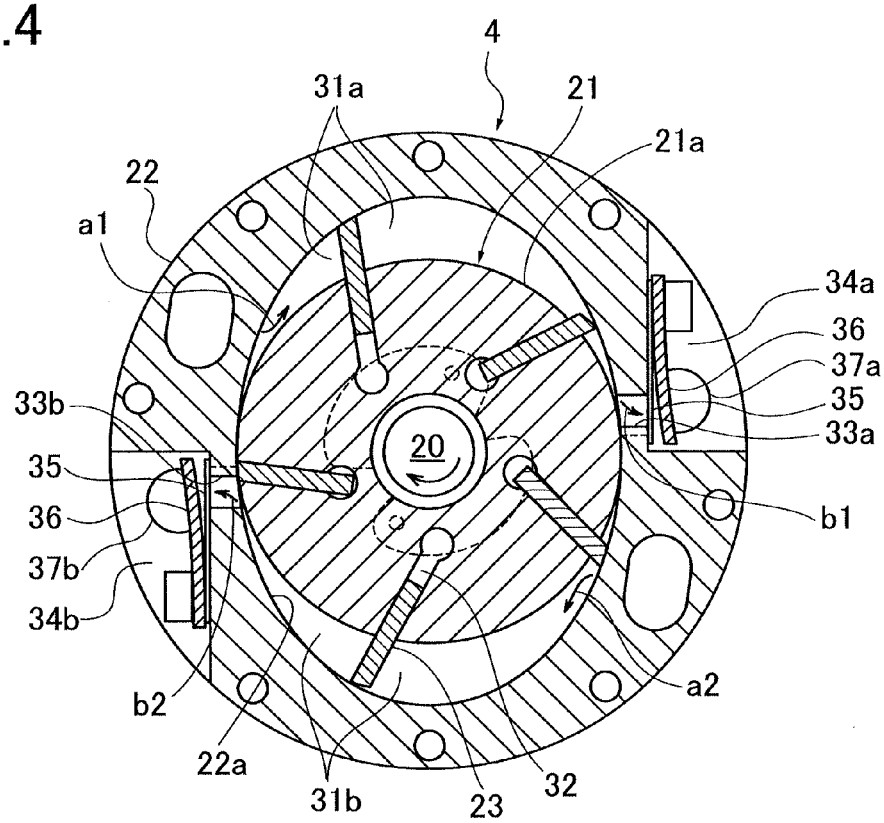
FIG. 4 is a cross-sectional view taken along line A-A of FIG. 3.

As shown in FIG. 4, the compressing mechanism unit (i.e., compressor pump) 4 includes a substantially cylindrical rotor 21 incorporated in the rotating axis 20; a cylinder 22 having a substantially oval inner surface 22*a* which surrounds the rotor 21 from an outer surface 21*a* of the rotor 21; five plate vanes 23 extendedly disposed from the outer surface 21*a* of the rotor 21 to the inner surface 22*a* of the cylinder 22; and two side blocks (a front side block 24 and a rear side block 25 (see, FIG. 2)) which covers both ends of the rotor 21 and the cylinder 22. FIG. 4 is a cross-sectional view taken along line A-A of FIG. 3. In FIG. 4, the housing 2 of the outer surface of the compressing mechanism unit (compressor pump) 4 is omitted.

O-rings 26 as a sealing member are disposed around the outer surfaces of the front and rear side blocks 24 and 25 (the O-ring of the front side block 24 is not shown.). The O-rings 26 hermetically separate an intake room (not shown) which is disposed between the front head 3 of the front side block 24 and the housing 2 from an exhaust room 27 disposed in the housing 2 of the rear side block 25 side. An oil separate unit 28 is attached in the exhaust room 27 in the outer surface of the rear side block 25.

The front side block 24 is fixed to the inner surface around the opening end of the front head 3 via a plurality of bolts. The outer surface of the rear side block 25 is fitted (pressingly fitted) into the inner surface 2*a* (see, FIG. 3). The front head side 24 of the compressing mechanism unit 4 received in the housing 2 is fixed to the front head 3 via the bolts. The rear head side 25 of the compressing mechanism unit 4 is retained so as to be fitted (pressingly fitted) into the inner surface 2*a* of the housing 2.

The electromagnetic clutch 5 is disposed on the outer surface of the front head 3. The rotation driving force of the engine (not shown) is transmitted to a pulley 29 via a belt (not shown). The first end of the rotating axis 20 (left hand side of FIG. 2) is fitted to a central through hole of an armature 30 of the electromagnetic clutch 5. The rotating axis 20 is supported by the central through holes of the front and rear side blocks 24 and 25.

The driving force of the engine transmitted to the pulley 29 via the belt (not shown) is transmitted to the rotating axis 20 (rotor 21) via the armature 30 by absorbing the armature 30 to the side surface of the pulley 29 by means of an excitation of an electromagnet (not shown) in the pulley 29 while operating the compressor 1 (the compressing mechanism unit 4).

(Structure and Operation of the Compressing Mechanism Unit 4)

As shown in FIG. 4, a plurality of compressing rooms 31*a* and 31*b* separated by the five vanes 23 located in an equal space are formed in spaces among the inner surface 22*a* of the cylinder 22, the outer surface 21*a* of the rotor 21, and both side blocks 24 and 25 (see, FIG. 2).

The vane 23 is slidingly disposed in the vane groove 32 formed on the rotor 21, and progresses in the outward direction by the back pressure by means of supplied the refrigerant oil to the vane groove 32. In FIG. 4, the compressing room formed in the upper space between the inner surface 22*a* of the cylinder 22 and the outer surface 21*a* of the rotor 21, is as the compressing room 31*a*. The compressing room formed in the lower space is as the compressing room 31*b*.

The cylinder 22 has the substantially oval inner surface 22*a* surrounding the exterior of the outer surface 21*a* of the rotor 21. Each of the compressing rooms 31*a* and 31*b* repeatedly increases and decreases the volume in the intake and exhaust processes of the refrigerant gas by the rotation of the rotor 21. The compressor 1 (the compressing mechanism unit 4) according to the first embodiment of the present invention includes twice intake and exhaust processes during one rotation of the rotor 21.

The cylinder 22 includes intake holes (not shown) which supply the refrigerant gas a1 and a2 to the compressing rooms 31*a* and 31*b* and exhaust holes 33*a* and 33*b* which exhaust the refrigerant gas b1 and b2 compressed in the compressing rooms 31*a* and 31*b*, respectively.

More particularly, the low pressure refrigerant gas is supplied to the compressing rooms 31*a* and 31*b* via the intake holes (not shown) in a process of increasing the volumes of the compressing rooms 31*a* and 31*b*, and is compressed in the compressing rooms 31*a* and 31*b* in a process of decreasing the volumes, resulting in making the refrigerant gas high temperature and high pressure. The high temperature and high pressure refrigerant gas b1 and b2 is exhausted to the exhaust chambers 34*a* and 34*b* which are separated spaces surrounded by the cylinder 22, the housing 2, and the two side blocks 24 and 25.

The exhaust holes 33*a* and 33*b* include an exhaust valve 35 which prevents from running back of the refrigerant gas to the compressing rooms 31*a* and 31*b*, and a valve support 36 which prevents an excessive distortion of the exhaust valve 35. The high temperature and high pressure refrigerant gas exhausted from the exhaust holes 33*a* and 33*b* to the exhaust chambers 34*a* and 34*b* is introduced to the oil separation unit 28 disposed in the exhaust room 27 via the exhaust paths 37*a* and 37*b* formed in the rear side block 25. The exhaust holes 33*a* and 33*b* (the exhaust valve 35 and the valve support 36) are disposed along a longitudinal direction of the rotor 21 (an axial direction of the rotating axis 20).

The oil separation unit 28 separates the refrigerant oil (the oil for vane back pressure which is leaked from the vane groove 32 on the rotor 21 to the compressing rooms 31*a* and 31*b*) from the refrigerant gas including the refrigerant oil and centrifugally separates the refrigerant oil by spirally rotating the high pressure refrigerant gas which is exhausted from the exhaust holes 33*a* and 33*b* and is introduced through the exhaust chambers 34*a* and 34*b*, and the exhaust paths 37*a* and 37*b*.

The refrigerant oil separated from the refrigerant gas in the oil separation unit 28 is reserved in the bottom of the exhaust room 27. The high pressure refrigerant gas after removing the refrigerant oil is exhausted to the condenser (not shown) through the exhaust port 8 (see, FIG. 1) of the exhaust room 27.

(Detailed Structure of Ribs 10*a* and 10*b*)

As shown in FIGS. 1 to 3, in the outer surface of the housing 2, the fitting units (brackets) 9*a* and 9*b*, which extend in a direction perpendicular to an axial direction of the rotating axis 20 rotatable with a center position the compressing mechanism unit 4, are integrally formed at the opposed position in the radial direction in the vicinity of the opening end (in FIG. 3, the up-down direction).

Each of the fitting units (brackets) 9*a* and 9*b* includes at least one through hole for at least one bolt 9*c* perpendicular to the axial direction of the rotating axis 20. A bolt (not shown) is inserted in the at least one through hole for the at least one bolt 9*c* of each of the fitting units 9*a* and 9*b*. The fitting units 9*a* and 9*b* are fixed to the fixing portion of the engine bracket (not shown) which attaches the vehicle engine. Then, the compressor 1 is fixed to the engine bracket (not shown).

Each of the ribs 10*a* and 10*b* extending in the vicinity of the position C (hereinafter, referred to as a rear side block fitting part) where the outer surface of the rear side block 25 of the compressing mechanism unit 4 is fitted (pressingly fitted) to the inner surface 2*a* of the housing 2, are integral formed on the outer surface of the housing 2 in the longitudinal direction from the center position the fitting units 9*a* and 9*b* to the axial direction of the rotating axis 20.

In operating the above compressor 1, since the exciting force such as the compress reaction force which is generated by the rotation of the rotor 21 (the rotating axis 20) during compressing the refrigerant gas in the compressing rooms 31*a* and 31*b* is periodically propagated in the cylinder 22, a periodic oscillation to the radial direction of the cylinder 22 is generated. This oscillation of the cylinder 22 is directly propagated from the inner surface of housing, which is fitted (pressingly fitted) to the rear side block 25, to the housing 2 via the rear side block 25. This oscillation causes to the exciting force that oscillates the housing 2.

In the first embodiment, since the ribs 10*a* and 10*b* are integral formed between each of the fitting units 9*a* and 9*b* which are fixed to the engine bracket (not shown) via the bolts and the rear side block fitting part C on the above outer surface of the housing 2, the rigidity of the portion between the fitting units 9*a* and 9*b* disposed on the outer surface of the housing 2 and the rear side block fitting part C, respectively, can be higher.

Thus, the propagation of the oscillation from the cylinder 22 in the vicinity of the rear side block fitting part C can be directly restricted by the ribs 10*a* and 10*b*. The oscillation of the housing 2 due to the oscillation of the cylinder 22 can be efficiently reduced (damping). Because the oscillation propagated to each of the fitting units 9*a* and 9*b* is decreased, the oscillation to the engine bracket (not shown) which is fixed via the bolts is also reduced.

Because the ribs 10*a* and 10*b* are integral formed between each of the fitting units 9*a* and 9*b* and the rear side block fitting part C on the above outer surface of the housing 2, such that the rigidity of housing 2 is higher, a characteristic frequency of the housing 2 can be a high frequency. Since the oscillation frequency of the cylinder 22 is restricted to reach the characteristic frequency of the housing 2, and an occurrence of a resonance phenomenon is prevented, this oscillation of the housing 2 due to the resonance phenomenon can be reduced.

The gas compressor according to the embodiment of the present invention includes the characteristics wherein the rotating axis is retained so as to be rotatable along a longitudinal direction of the housing in the center portion of the compressing mechanism unit, the fitting unit (bracket) is formed at an opposed position in the radial direction of the outer surface on the housing to extend to the direction perpendicular to the axial direction of the rotating axis, and the at least one rib is formed in the longitudinal direction from the center portion of the fitting unit to the axial direction of the rotating axis.

In accordance with the gas compressor of the present invention, each of the ribs extends from the fitting units to a position where the second end of the compressing mechanism unit is pressing fitted into the inner surface of the housing, on the outer surface of the housing. Since the ribs are integral formed with the housing, a rigidity of the housing from the fitting units to the vicinity of the position where the second end of the compressing mechanism is pressingly fitted into the inner surface of the housing can be higher.

Because the propagation of the oscillation from the compressing mechanism unit is directly restricted by the ribs during operating the gas compressor, the oscillation of the housing can be efficiently reduced even if the oscillation generated in the compressing mechanism unit is directly propagated to the housing.

What is claimed is:

1. A gas compressor, comprising:

a substantially cylindrical housing which has an opening at a first end thereof and is closed at a second end;

a front head which covers an end face of the opening of the housing;

a compressor pump unit which is fixed in the front head at a first end, is received in the housing excluding a portion of the first end, and exhausts a compressed high pressure medium to an exterior by rotating a rotating axis due to a driving force from a driving source;

a bracket which is formed on an outer surface at the end face of the opening of the housing and is to be fixed to an external structure member; and at least one rib, wherein an outer surface of a second end of the compressor pump unit is fixed to be pressingly fitted to an inner surface of the housing, and the at least one rib extends from the bracket to a position where the second end of the compressor pump unit on the outer surface of the housing is pressingly fitted to the inner surface of the housing, the at least one rib being integral formed with the outer surface of the housing.

2. The gas compressor according to claim 1, wherein the at least one rib comprises an even number of ribs arranged to face each other.

3. The gas compressor according to claim 1, wherein the rotating axis is retained so as to be rotatable along a longitudinal direction of the housing in a center position of the compressor pump unit, wherein the bracket is formed at an opposed position in a radial direction of the outer surface on the housing to extend in a direction perpendicular to an axial direction of the rotating axis, and wherein the at least one rib is formed in the longitudinal direction from a center position of the bracket along the axial direction of the rotating axis.

* * * * *